United States Patent [19]

Kozacka

[11] 3,969,694

[45] July 13, 1976

[54] ELECTRIC FUSE FOR ELEVATED CIRCUIT VOLTAGES CAPABLE OF INTERRUPTING SMALL OVERLOAD CURRENTS

[75] Inventor: Frederick J. Kozacka, South Hampton, N.H.

[73] Assignee: The Chase-Shawmut Company, Newburyport, Mass.

[22] Filed: June 11, 1975

[21] Appl. No.: 585,961

[52] U.S. Cl. ..... 337/161; 337/293

[51] Int. Cl.[2] ..... H01H 85/12

[58] Field of Search ..... 337/158, 159, 160, 161, 337/162, 291, 292, 293

[56] References Cited

UNITED STATES PATENTS

| | | | |
|---|---|---|---|
| 3,735,317 | 5/1973 | Jacobs, Jr. | 337/291 |
| 3,848,214 | 11/1974 | Salzer | 337/158 |
| 3,881,161 | 4/1975 | Kozacka | 337/161 |

*Primary Examiner*—Harold Broome
*Attorney, Agent, or Firm*—Erwin Salzer

[57] ABSTRACT

An electric fuse adapted to form multibreaks at the occurrence of small protracted overload currents includes a first fusible element having a relatively small resistance which supports at a predetermined point thereof means for causing formation of a break at the occurrence of small protracted overloads. The fuse includes a second fusible element having a relatively high resistance shunted across said predetermined point of said first fusible element and has ends adapted to initiate arcing at small current intensities at points thereof located immediately adjacent said first fusible element. Blocks of metal are arranged in spaced relation from said first fusible element in the zone of arcing established by fusion of said ends of said second fusible element to increase the contamination of said zone by products of arcing resulting from vaporization of said blocks.

A rod member of electric insulating material is arranged parallel to, but spaced from, the axis of the casing of the fuse. This rod member engages and supports full turns of the first and of the second fusible element which are each formed by a helical winding only at one single point of the particular turn. This rod member of electric insulating material forms also a support for the aforementioned arc product generating blocks.

4 Claims, 3 Drawing Figures

ELECTRIC FUSE FOR ELEVATED CIRCUIT VOLTAGES CAPABLE OF INTERRUPTING SMALL OVERLOAD CURRENTS

BACKGROUND OF THE INVENTION

This invention is in part an outgrowth of the subject-matter of U.S. Pat. No. 3,735,317; May 22, 1973 to Philip C. Jacobs, Jr. for ELECTRIC MULTIBREAK FORMING CARTRIDGE FUSE and is in another part an outgrowth of the subject-matter of U.S. Pat. No. 3,848,214 to Erwin Salzer, Nov. 12, 1974 for METHOD OF ASSEMBLING ELECTRIC HIGH-VOLTAGE FUSES AND SUBASSEMBLY THEREFOR.

The above patent to Jacobs solves the problem of forming series breaks in a fusible element incident to occurrence of small protracted overloads. The fusible element or fuse link is provided with a link-severing low fusing point overlay which forms a break at very small overloads, e.g., the 1 hour fusing current. The fuse of Jacobs includes a shunt across the overlay portion of the fuse link which shunt is adapted to generate relatively large amounts of heat at the ends thereof conductively connected to the fusible element at opposite sides of said overlay thereof. Normally the shunt does not carry any significant current on account of its high resistance. The shunt begins to carry a significant current following formation of a break by a metallurgical reaction between the base metal of the fusible element and the overlay metal at the point of said overlay. Thereafter the ends of the shunt that generate relatively large amounts of heat fuse and kindle arcs between the fusible element and its shunt. These arcs are supposed to form two additional breaks in the fusible element, one to each side of the overlay thereof. Because these arcs are relatively low current arcs, the time involved in forming the two aforementioned additional breaks in the fusible element is relatively long.

It is, therefore, one object of this invention to provide means that contaminate the arc gaps formed between the fusible element and its shunt by evolution of highly ionizable metal vapors, thus greatly accelerating the formation of breaks in the fusible element to both sides of said overlay thereof.

Another object of this invention is to provide simple means for conductively connecting the ends of said shunt to points of said fusible element situated to opposite sides of said overlay thereof.

The aforementioned patent to Salzer discloses a fixture for making fuses for elevated circuit voltages. The cylindrical plug terminals of the fuse form a part of the fixture and are tied together by a plurality of metal rods extending parallel to the common axis of the plug terminals. Thus the plug terminals and said plurality of metal rods form jointly a squirrel-cage-like structure. A fusible element is wound helically around the metal rods and its ends are conductively connected to the axially inner end surfaces of the plug terminals. Thereafter the entire assembly is inserted in coaxial relation into a tubular casing of electric insulating material and the ends of the latter are pinned to the plug terminals. Then the casing is filled with a pulverulent arc-quenching filler, preferably quartz sand. After the pulverulent arc-quenching filler has been duly compacted it is capable of supporting the helically wound fusible element or elements. Thus the fusible element supporting rods are not needed any longer and may be withdrawn in a direction longitudinally thereof from the fusible element and removed from the casing by appropriate bores in one of the plug terminals. The resulting high-voltage fuses contain a relatively higher volume of pulverulent arc-quenching filler than conventional high-voltage fuses, i.e. the filler volume is increased by a volume equal to that normally occupied by mandrel-like solid supports for the fusible element. Elimination of such supports is further desirable because of their relatively high cost, the danger of becoming more or less conductive under the heat of high-current arcs, the danger of evolving too much gas under the action of such arcs, etc. Fuses as shown in the above patent to Salzer do not lend themselves to interruption of protracted very small overload currents, e.g. the three hour fusing current.

It is, therefore, another object of this invention to modify the fuses disclosed in the above patent to Salzer in such a way as to impart them with the ability of effectively interrupting small protracted overload currents. A more specific object of this invention is to modify the type of fuses disclosed in the above patent to Salzer in such a way as to adapt the same to the low overload current-interrupting means disclosed in the above Jacobs patent.

A still narrower object of this invention is to modify the fuses disclosed in the above patent to Salzer by incorporation into the same of a greatly improved version of the protracted low overload current series multibreak forming means of Jacobs.

SUMMARY OF THE INVENTION

Electric fuses embodying this invention include a first low resistance fusible element conductively interconnecting a pair of terminal elements and forming a plurality of serially related points of reduced cross-sectional area. Said first fusible element has means at a predetermined point thereof causing formation of a break therein at the occurrence of small protracted overload currents. A second fusible element having a relatively high resistance is shunted across said predetermined point of said first fusible element. Said second fusible element has ends immediately adjacent said first fusible element conductively connected to said first fusible element. Said ends of said second fusible element are adapted to melt and to initiate arcing at points thereof located immediately adjacent said first fusible element at smaller current intensities than those required to cause formation of a break in the center region of said second fusible element. Fuses embodying this invention further include metal blocks spaced from said first fusible element arranged in the zone of arcing established by fusion of said ends of said second fusible element to increase the contamination of said zone of arcing by products of arcing resulting from vaporization of said metal blocks to accelerate formation of series breaks in said first fusible element.

DESCRIPTION OF PREFERRED EMBODIMENT

Figure 1:
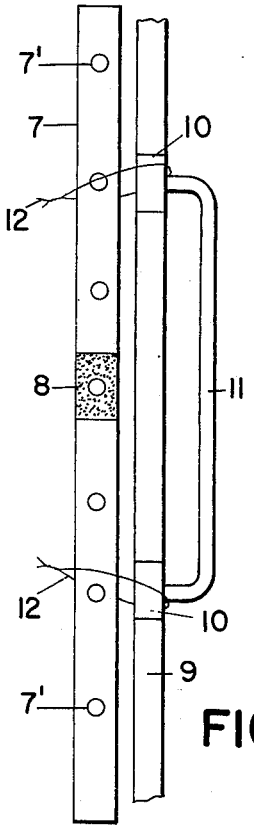
FIG. 1 is a diagrammatic representation of some of the essential parts of a fuse embodying this invention.
Figure 3:
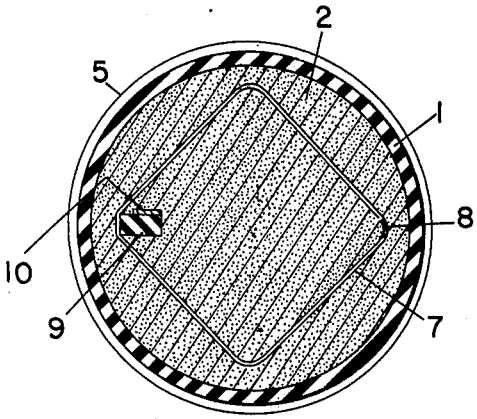
FIG. 3 is a cross-section of the structure of FIG. 2.
Figure 2:
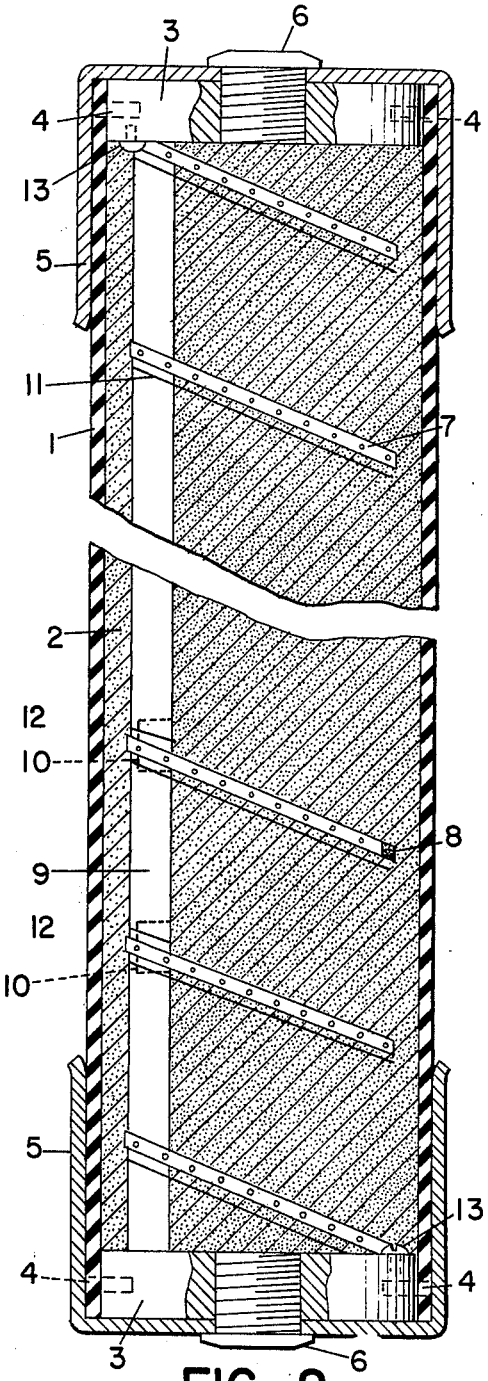
FIG. 2 is a diagrammatic longitudinal section of a fuse embodying this invention.

Referring to the drawings, numeral 1 has been applied to indicate a tubular casing of electric insulating material, e.g. a melamine-glass-cloth laminate. Casing 1 is filled with a pulverulent arc-quenching filler 2, e.g. quartz sand. The ends of casing 1 are closed by a pair of metallic terminal elements 3 in the form of cylindrical plugs 3. The plug terminals 3 are affixed to the ends of casing 1 by steel pins 4 projecting radially into plug terminals 3. The ferrules 5 are mounted on the outer ends of casing 1 and affixed to plug terminals 3 by means of hex screws 6. Plug terminals 3 are conductively interconnected by a first fusible element 7 embedded in pulverulent arc-quenching filler 2. Fusible element 7 has a relatively small resistance and is preferably formed by a ribbon of sheet silver provided with serially arranged perforations 7'. Fusible element 7 is preferably in the shape of a helical winding as indicated in FIGS. 2 and 3. Element 7 might also be straight rather than helical. However, the straight fusible element 7 shown in FIG. 1 is but a diagrammatic representation of the helical shape indicated in FIGS. 2 and 3. Perforations 7' form a plurality of serially related points of reduced cross-sectional area where arc initiation occurs incident to major short-circuit-current-like fault currents. Fusible element 7 is provided at a predetermined point thereof with means 8 for causing formation of a break therein at the occurrence of small protracted overloads. Means 8 is preferably an overlay of a low fusing point metal, e.g. tin, that severs upon fusion thereof by a metal diffusion process fusible element 7 at the point where overlay 8 is located. Reference character 9 has been applied to indicate a rod of electric insulating material that extends parallel to the axis of casing 1, but is spaced from said axis. The ends of rod 9 are affixed to terminal elements 3, e.g. inserted into recesses thereof (not shown in the drawings). As shown in FIG. 3 the cross-section of rod 9 is preferably rectangular, and rod 9 supports on its surface a pair of axially spaced metal blocks 10, e.g. copper blocks. Blocks 10 are conductively interconnected by a resistor wire 11. As shown in FIG. 1 an upper closed wire loop 12 is wound around fusible element 7 and upper metal plate or block 10 and a lower closed wire loop 12 is wound around fusible element 7 and lower metal plate or block 10. Upper wire loop 12, upper plate 10, resistor 11, lower plate 10 and lower wire loop 12 form a shunt across that portion of fusible element 7 that supports link-severing overlay 8. Wire loops 12 are convenient means for establishing conductive fusible connections between parts 7 and 10.

Normally the above shunt current path does not carry any current. Small protracted overloads result in fusion of overlay 8 and, therefore, fusible element 7 is severed by a metallurgical reaction at a point situated between wire loops 12. Hence a current flows through shunt 12,10,11,10,12. The parameters of that shunt are selected in such a way that initial fusion and arc inception occur at, or near to, the points of contact with fusible element 7, i.e. at, or near to, the points where wire loops 12 physically engage fusible element 7. In other words, the portion of the shunt 12,10, 11,10,12 first to be destroyed by arcing are the closed loops 12 formed of thin wire. The amount of metal vapor resulting from vaporization of wire loops 12 is small and, therefore, the resistance of the arc gaps which take the place of wire loops 12 following their vaporization is relatively high. When wire loops 12 burn rapidly back into metal blocks 10, the metal of which these blocks are made, e.g. copper, is vaporized. The arc products resulting from vaporization of copper blocks 10 contaminate the arc gaps formed between parts 10 and 7. Due to the increased ionization of these arc gaps the current flow in the shunt including metal blocks 10 and resistance wire 11 greatly increases. This increase of the shunt current, in turn, results in more rapid severing of fusible element 7 at the two points thereof juxtaposed to metal blocks 10.

When manufacturing the fuse structure shown in FIGS. 2 and 3 the fusible element 7 is wound helically around four rods forming jointly with plug terminals 3 a squirrel-cage-like structure. These four rods define a prism which is substantially square in cross-section. Three of the aforementioned rods around which fusible element 7 is wound are of a stiff metal and are withdrawn from the fusible element 7 and from the casing 1 as disclosed in detail in the aforementioned U.S. Pat. No. 3,848,214 to Salzer. The fourth rod around which fusible element 7 is wound is insulating rod 10. Rod 10 is not withdrawn from fusible element 7 and not removed from casing 1. In the structure shown in FIGS. 2 and 3 full turns of fusible element 7 engage rod member 10 at a single point. Hence full turns of fusible element 7 are only supported by the pulverulent arc-quenching filler 2, except at one single point of the particular turn where the latter is supported by tie rod 9 by which both terminal elements 3 are tied together. As clearly shown in FIG. 2 the ends of fusible element 7 are screwed by means of screws 13 against the axially inner end surfaces of terminal plugs 3 and thus also supported at these two specific points. The fact that turns of helical winding 7 situated between screws 13 are supported at one point by insulating rod 9 tends to increase the dimensional stability of helical winding 7. The tie rod 9 between plug terminals 3 has the additional function of supporting the arc-gap-contaminating metal blocks 10. While the metal vapors evolved from metal blocks 10 are highly effective in reducing the resistance of the current path shunting two points of fusible element 7 at opposite sides of overlay 8, the metal vapors evolved from metal blocks 10 have no adverse effect as far as the capacity of the fuse structure to interrupt major fault currents is concerned.

As shown in FIGS. 2 and 3 the first fusible element 7 is wound in quarter turn sections around a space in the form of a four-sided prism and full turns of the first fusible element 7 are supported at but one single point thereof by the terminal-interconnecting tie rod 9. FIG. 2 indicates diagrammatically a similar arrangement for the second fusible element or more specifically its resistor wire portion 11. The latter is wound in quarter turn sections helically around a space in the form of a four-sided prism and full turns of wire 11 are supported at a single point by insulating rod 9.

I claim as my invention:

1. An electric fuse adapted to form multibreaks at the occurrence of small protracted overload currents including a. a tubular casing of electric insulating material;

b. a pulverulent arc-quenching filler inside said casing;

c. a pair of metallic terminal elements closing the ends of said casing;

d. a first fusible element having a relatively small resistance and forming a plurality of serially related points of reduced cross-sectional area conductively interconnecting said pair of terminal elements, said first fusible element having means at a predetermined point thereof for causing formation of a break therein at the occurrence of small protracted overload currents;

e. a second fusible element having a relatively high resistance shunted across said predetermined point of said first fusible element and having ends immediately adjacent said first fusible element conductively connected to said first fusible element, said ends of said second fusible element being adapted to melt and to initiate arcing at points thereof located immediately adjacent said first fusible element at smaller current intensities than those required to cause formation of a break in the center region of said second fusible element; and f. blocks of metal spaced from said first fusible element arranged in the zone of arcing established by fusion of said ends of said second fusible element to increase the contamination of said zone of arcing by products of arcing resulting from vaporization of said blocks of metal to accelerate formation of series breaks in said first fusible element.

2. An electric fuse as specified in claim 1 wherein a. said first fusible element is formed by a substantially helical winding;

b. a rod member of electric insulating material is arranged parallel to, but in spaced relation from, the axis of said casing and having ends supported by said pair of terminal elements;

c. said rod member engaging and supporting full turns of said helical winding at one single point only, all other points of said full turns of said helical winding being unsupported by winding support means having axially outer ends in engagement with said pair of terminal elements; and d. said rod member also supporting said blocks of metal.

3. An electric fuse as specified in claim 1 wherein a. said first fusible element and said second fusible element are wound in quarter turn sections around a space in the form of a four-sided prism;

b. full turns of said first fusible element and full turns of said second fusible element are supported by a terminal-interconnecting tie rod of electric insulating material only at a single point thereof; and c. wherein said pair of metal blocks is supported by said terminal-interconnecting tie rod.

4. An electric fuse as specified in claim 1 wherein said ends of said second fusible element in electric contact with said first fusible element are formed by endless loops of wire encircling said first fusible element.

* * * * *